United States Patent [19]

Birenbaum

[11] 4,233,002

[45] Nov. 11, 1980

[54] FUEL INJECTION SYSTEM

[76] Inventor: Benjamin Birenbaum, 133 Richmond St. West, Toronto, Ontario, Canada, M5H 2L7

[21] Appl. No.: 904,199

[22] Filed: May 9, 1978

Related U.S. Application Data

[63] Continuation-in-part of Ser. No. 768,843, Feb. 15, 1977, abandoned, which is a continuation-in-part of Ser. No. 660,912, Feb. 26, 1976, abandoned.

[51] Int. Cl.[3] ..... F02M 41/04; F04B 23/00

[52] U.S. Cl. ..... 417/485; 417/502

[58] Field of Search ..... 123/139 AL, 139 AM, 123/139 BE, 139 AF, 139 DP; 417/442, 485, 502, 510; 137/624.18, 624.2, 627

[56] References Cited

U.S. PATENT DOCUMENTS

| | | | |
|---|---|---|---|
| 2,133,813 | 10/1938 | Gillen | 417/502 X |
| 2,391,174 | 12/1945 | Lownsbery | 123/139 AL |
| 3,307,491 | 3/1967 | Wolff | 417/485 X |
| 3,320,892 | 5/1967 | Wolff | 417/485 X |
| 3,908,619 | 9/1975 | Bittelmeyer | 123/139 AL X |

FOREIGN PATENT DOCUMENTS

| | | | |
|---|---|---|---|
| 575931 | 5/1933 | Fed. Rep. of Germany | 123/139 BE |
| 512375 | 1/1955 | Italy | 123/139 BE |
| 275572 | 8/1951 | Switzerland | 123/139 BE |
| 611423 | 10/1948 | United Kingdom | 123/139 BE |

*Primary Examiner*—Michael Koczo

[57] ABSTRACT

The specification describes a distributor apparatus provided with a plurality of distributor valve arrangement in a circular pattern and including valve plungers. The distributor apparatus includes a rotary distributor cam provided with a single distributor lobe for orbiting in the circular pattern and for moving the valve plungers in succession from a non-distributing to a stationary distributing position. The cam lobe has a planar face for holding the valve plungers in the distributing position throughout the entire delivery stroke of a pump unit plunger metering and pumping fuel to the distributor apparatus.

2 Claims, 11 Drawing Figures

FUEL INJECTION SYSTEM

This is a continuation in part application of U.S. Pat. Application Ser. No. 768,843 filed Feb. 15, 1977, now abandoned, which is a continuation in part of U.S. Pat. Application Ser. No. 660,912 filed Feb. 26, 1976, to Benjamin Birenbaum, now abandoned.

1. FIELD OF THE INVENTION

This invention relates to a distributor of a fuel injection pump which distributes metered amounts of fuel pumped by a pump unit for use in a multicylinder internal combustion engine.

2. BACKGROUND OF THE INVENTION

There are presently two general types of fuel injection systems including the common in-line system and the distributor system. The effectiveness of both systems is limited due to the fact that the degree of pressure and the amount of fuel delivered to each cylinder changes over time, which results in an unequal supply of fuel and an untuned engine. Some of the cylinders burn too lean and the others burn too rich, so there is excess fuel consumption, a loss of engine power and smoking at lower R.P.M. The unequal distribution occurs as a result of wear on the system components, which increases the more the system is used.

The present common pump unit of the type having a pump plunger with one or two helical slots for metering the fuel output includes one or two inlet drillings in the cylinder bushing, which function both as an inlet for admitting fuel into the pump cylinder bores and as an outlet for spilling out unused fuel from the pump cylinder in conjunction with the fuel metered by the pump plungers helical slot or slots. This type of pump element is superior to and more durable than other known types of pump elements. However it cannot be used as a single pump unit on a distributor fuel pump for a multi-cylinder diesel engine because it will not pump at higher speeds. For example, when the pump element is forced to reciprocate at extremely high speeds, it ceases to pump and will only resume pumping when the speed is lowered. This is due to the fact that the rapid reciprocating of the pump produces a foaming of the fuel, as a result of a mixture disorder in the mutual inlet-spill drillings of the pump cylinder chamber, so that the drillings are blocked and fuel is neither admitted to nor pumped from the pump chamber.

It is therefore a prime object of the present invention to provide a fuel injection system of the distributor type, which is highly durable and which provides equal quantities of fuel charges to each cylinder of an internal combustion engine.

It is another object of the present invention to provide a fuel injection system of the type described above, in which the metered amount of fuel delivered to each cylinder is consistent from cylinder to cylinder throughout the working or life span of the fuel injection pump.

It is another object of the present invention to modify the common pump unit of the type having a pump plunger with one or two helical slots as described above, for use in a distributor type diesel fuel pump.

A further object of the present invention is to provide an improved high-pressure distributor type fuel injection pump including a distributor assembly for distributing fuel charges metered and pumped from a pump unit to a multi-cylinder internal combustion engine.

BRIEF SUMMARY OF THE INVENTION

The above objects are achieved according to this invention by providing a distributor assembly including a plurality of plunger type valves used for the sole purpose of distributing fuel from a pump unit to the cylinders of a multi-cylinder internal combustion engine. The purpose of the pump is to pump and meter fuel to the distributor. The pump unit itself is not involved in the distribution of fuel.

Each of the cylinders in the multi-cylinder engine is connected with a delivery tube to the pump unit via the distributor assembly. Only one delivery channel is in communication with the pump unit at any one time, so that the delivery channels of the various cylinders are connected to the pump unit in sequence. The individual delivery channels and tubes are connected to the pump unit for every delivery stroke of the pump plunger.

According to a preferred embodiment, each of the distributor plunger type valves is operated by means of a flat-faced distributor cam lobe. As a result of the construction of the cam lobe, the distributor plunger valves are held in a stationary position while connecting the delivery channels to the pump unit throughout the entire delivery stroke of the plunger of the pump unit. Due to the stationary position of the distributor plunger valves throughout the delivery stroke of the plunger the wear on the individual distributor plungers, bores and drilling ports is less than the wear on distributor systems in which the distributor is constantly moving. In the present system, the quantity of fuel distributed to each cylinder is consistent from cylinder to cylinder over time as the unit operates.

BRIEF DESCRIPTION OF THE DRAWINGS

The aforementioned and other objects, advantages and features of the present invention will become apparent in the following detailed description of the preferred embodiments according to this invention, having reference to the accompanying drawings in which.

DETAILED DESCRIPTION OF THE PREFERRED EMBODIMENTS ACCORDING TO THIS INVENTION

Figure 1:
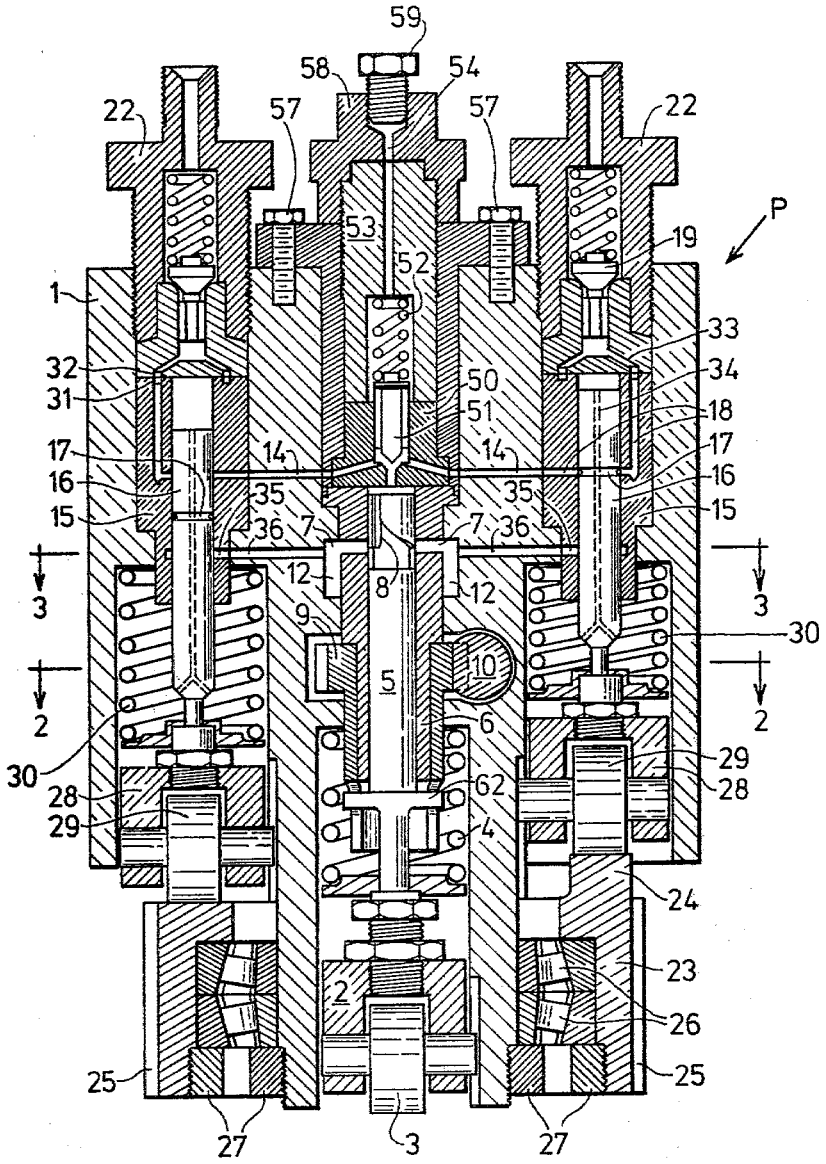
FIG. 1 is a cross-sectional view of a fuel injection pump head according to this invention.
Figure 6:
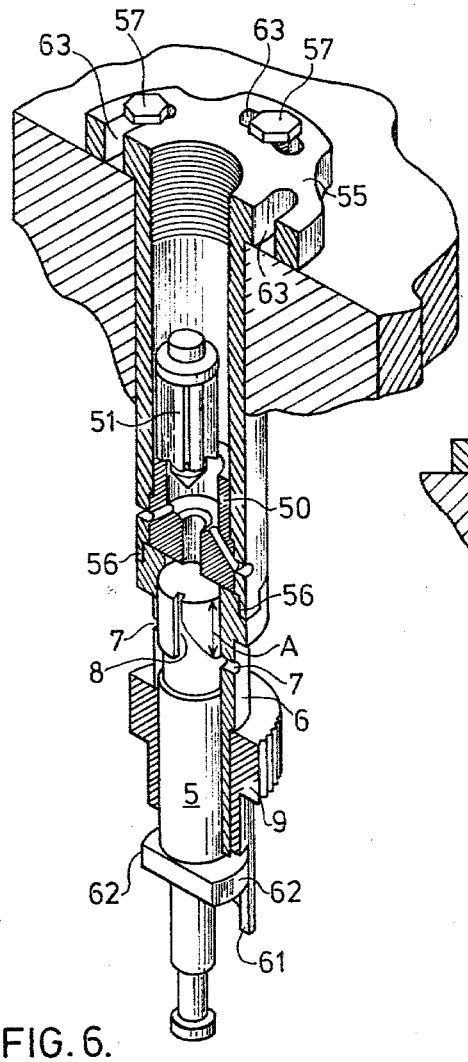
FIG. 6 is a sectional view of a pump unit for pumping and metering fuel according to this invention.

Referring primarily to FIG. 1, a fuel injection pump comprises a hydraulic pump head generally indicated at P including a pump head casing 1 and a pump unit having a pump plunger 5 reciprocable within a cylinder bore formed by bushing 6, as best shown in FIG. 6. Located below the pump plunger is a camshaft follower roller 3 rotatably mounted in its cam shaft follower 2.

Figure 4:
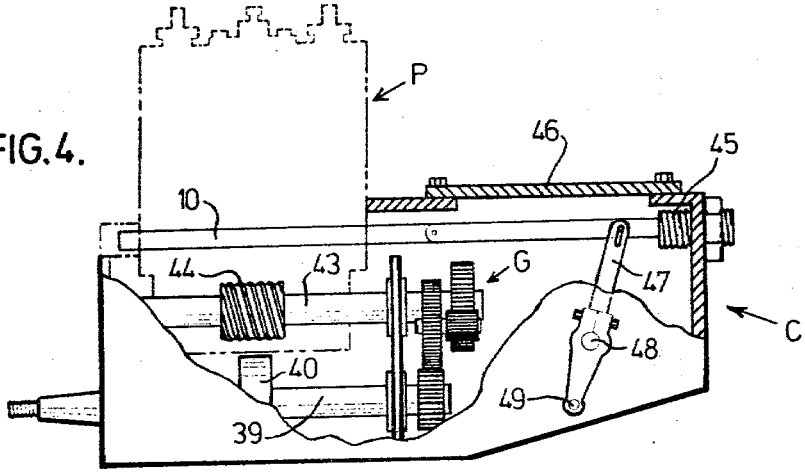
FIG. 4 is a front elevational view of the fuel injection pump head of FIG. 1 mounted on a pump housing.
Figure 5:
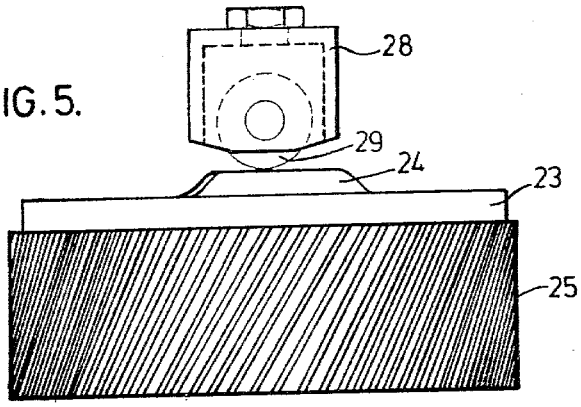
FIG. 5 is a front elevational view of a cam mechanism for operating the distributor valve plungers according to this invention.

The fuel injection pump head is mounted in a pump housing as shown in FIG. 4. The pump housing, which does not constitute part of the present invention, includes a cam shaft 39 provided with a cam lobe 40. The cam shaft is driven by an engine (not shown) and the cam lobe reciprocates pump plunger 5 withing its cylinder bore through roller 3 and follower 2. The pump unit meters and pumps fuel to the distributor assembly arranged around it.

The cam shaft 39 is meshed with the pinion shaft 43 with a set of reduction gears generally indicated at G. Pinion gear 44 meshes with ring gear 25 of the distributor cam 23 mounted at the base of the fuel injection pump head. Cam 23 is provided with a planar-faced distributor cam lobe 24. The distributor cam and its bearings are retained in the pump head casing by means of retaining nuts 27.

Arranged around the pump cylinder is a plurality of distributor valves including valve plungers 16 mounted in their respective cylinders formed by means of bushings 15. Each of the distributor valve plungers 16 is provided at its lower end with a distributor cam follower 28 and a distributor follower roller 29, rotatably mounted therein. The distributor cam rotates on bearings 26 and cam lobe 24 orbits from one distributor valve plunger to another to reciprocate them within their respective cylinders in succession through rollers 29 and followers 28.

Figure 3:
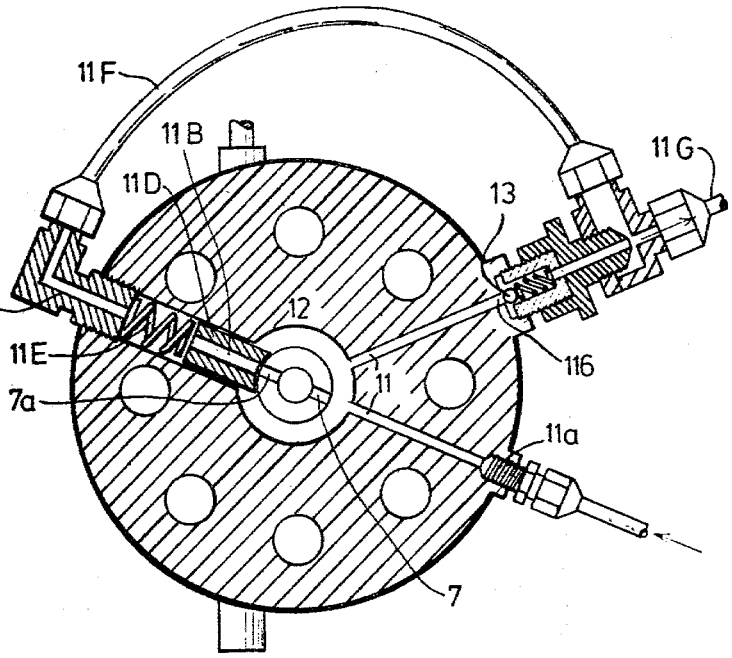
FIG. 3 is a representative sectional view of the fuel injection pump head of FIG. 1 taken along the lines 3—3.

Fuel is supplied by means of a low pressure supply pump (not shown) from a fuel tank (not shown) to fuel reservoir 12 through fuel supply duct 11, as shown in FIG. 3. Duct 11 extends from inlet **11*a* to reservoir 12 and back to outlet port 11*b* to a pressure equalizer check valve 13**, which is mounted at the outlet port for equalizing pressure in the system so as to provide fuel circulation with a fuel tank (not shown) for pump cooling and air venting.

The fuel (under low pressure) which is in the pump fuel reservoir 12 enters the pump cylinder chamber through one inlet drilling 7 while the pump plunger 5 is held in its lowest position by means of a plunger pressure spring 4. As cam shaft 39 is rotated, lobe 40 lifts pump plunger 5 through roller 3 and follower 2 upwardly through a delivery stroke to its uppermost position, as shown in FIG. 1. The fuel, which is under pressure throughout the delivery stroke, lifts pump check valve 51 up off its seat in pump check valve body 50, against the pressure of spring 52. As the fuel passes from the pump cylinder it enters a plurality of delivery ducts 14 which are drillings in the pump casing extending from the check valve through the pump casing to the distributor valves. The number of delivery ducts equals the number of cylinders in the engine.

Figure 7:
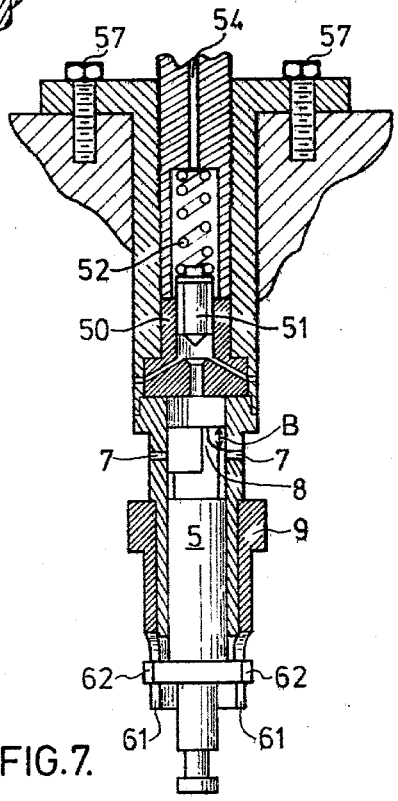
FIG. 7 is a front elevational view of the pump unit of FIG. 6 when adjusted to meter a different quantity of fuel.

Pump plunger 5 includes one helical slot 8. Slot 8 is machined in the upper part of the pump plunger in the area of spill drilling **7*a*. The relation of the helical slot, with respect to the spill drilling 7*a*, changes with partial rotation of pump plunger 5, thereby determining the effective part of the delivery stroke of the pump plunger for fuel metering purposes. In FIG. 6 the effective length of the delivery stroke is indicated by the length of arrow a. In FIG. 7, the effective length of the delivery stroke is indicated by arrow B. in FIG. 7, the delivery part of the stroke is completed before the pump plunger reaches its top position because spill drilling 7*a* is unveiled by the helical slot. The fuel which is delivered into the pump chamber, but which is not pumped by the pump, flows back to the fuel tank via the spill drilling 7*a* to spill duct 11C through drilling 11B of spill sleeve 11D to the circulating or fuel returning line 11G as shown in FIG. 3**.

The pump cylinder bore is provided with a pump cylinder bushing 6 and a fuel reservoir 12 surrounding the pump cylinder bushing for supplying fuel to the pump unit through inlet 7. The fuel in the fuel reservoir continuously cools the cylinder bore as it circulates through duct 11 back to return line 11G via pressure equalizer check valve 13. Spill sleeve 11D is held in the pump body against the pump cylinder bushing 6 by pressure spring 11E, so that the spill sleeve separates spill drilling **7*a* from pump fuel reservoir 12 and inlet drilling 7, so that the spilled fuel is channeled from the spill drilling 7*a* through drilling 11B of spill sleeve 11D to the spill duct 11C and through bypass pipe 11F to return line 11G**.

Figure 2:
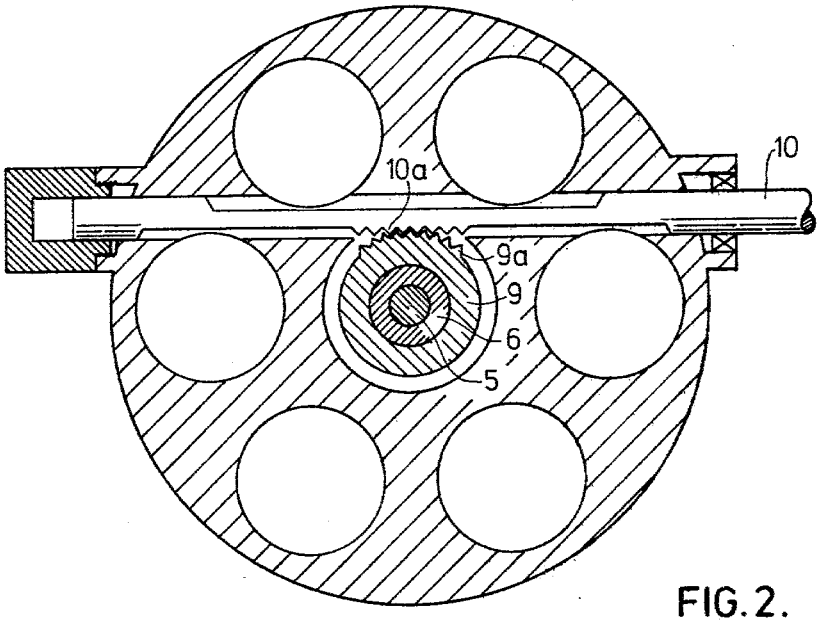
FIG. 2 is a representative section of the fuel injection pump head of FIG. 1 and FIG. 11 taken along the lines 2—2.
Figure 8:
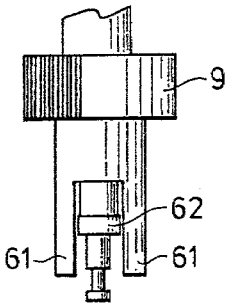
FIG. 8 is a side elevational view representative of the bottom portions of the pump unit shown in FIG. 6 and 7.
Figure 9:
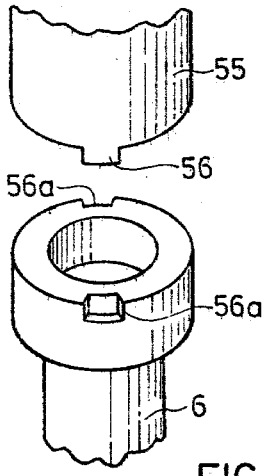
FIG. 9 is an enlarged exploded view showing the central section of the pump unit of FIGS. 6 and 7.

Pump plunger 5 is rotated partially through the axial movement of control rack 10 provided with gears **10*a* which mesh with gears 9*a* of control sleeve 9, as shown in FIG. 2. Pump plunger 5 includes at its lower end a pair of radial extensions 62 which are engaged in slots of the control sleeve formed by downward extensions 61, as shown in FIG. 8**. Therefore, the pump plunger moves with the control sleeve.

It is also possible to completely eliminate the use of pump bushing 6 and the fuel reservoir 12, as well as the spill sleeve 11D. In such a construction, the inlet drilling extends directly to the pump bore and a separate spill drilling extends from the same pump bore. Both of these drillings extned through the pump body.

Figure 10:
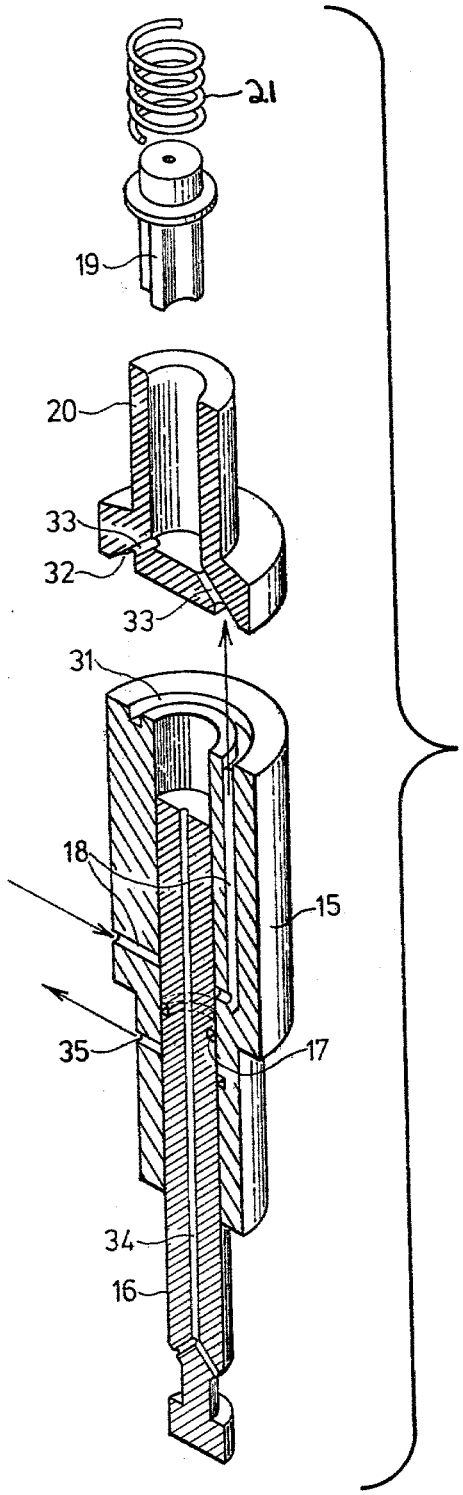
FIG. 10 is a sectional view of a distributor valve according to this invention.

Referring to FIG. 10, the distributor valve includes drilling 18 which passes through bushing 15 to form a continuation of one of the delivery ducts 14. Located at the upper end of drilling 18 is an annular channel 31, only half of which appears in FIG. 10. Located about bushing 15 is a delivery valve body 20 having an annular channel 32 at its lower end in communication with channel 31. Extending upwardly from channel 32 are drillings 33 leading to the interior of the delivery valve body. Bushing 15 and delivery valve body 20 are retained by fitting 22.

Each of the distributor valve plungers includes an annular groove 17. When the individual distributor valve plungers are in a distributing position, groove 17 is aligned with drilling 18. Annular channels 31 and 32 as well as drilling 33 form a continuation of the delivery duct and drilling. The tubular valve plungers also include drillings 34 for the purpose of breathing during operation of the distributor. An annular groove and outlet drilling 35 is provided in bushing 15 for collecting any possible seeping fuel, some of which lubricates the valve plunger. Drilling 35 is connected with drilling 36 extending through the pump casing and leading to the pump fuel reservoir 12.

Each of the distributor valves operates in the following manner: as distributor cam 23 is rotated, the flat-faced distributor cam lobe 24 lifts each of tbe cam follower rollers and its follower 28 of the distributor valves in succession, thereby lifting each of the distributor valve plungers in sequence within their bushings. While one of the distributor valve plungers is in an upper open position held by cam lobe 24, the remaining distributor valve plungers are held, by pressure springs 30, in their lowermost closed positions on the flat upper surface of cam 23 through their followers and follower rollers, as indicated by the distributor valve plunger shown in the left-hand portion of FIG. 1. The distributor valve plunger in the right-hand portion of FIG. 1 is in its uppermost open position. As is to be understood from the drawings and due to the close fit between each of the valve plungers and its respective bushing, drillings or delivery passages 18 are cut off from delivery ducts 14 when the distributor valve plungers are in their lowermost position. However, when a distributor valve plunger is lifted by means of cam lobe 24 of cam lobe 23, the distributor valve plunger annular groove 17 is in alignment with drilling 18, thereby making a continuous path around the valve plunger body so that fuel flows from the pump unit through duct 14 and drilling 18 via annular groove 17. As earlier mentioned, although all the ducts are full of fuel under pressure, fuel cannot pass through more than one distributor valve body plunger at any one time because distributor cam 23 is only provided with one cam lobe.

A critical feature required in fuel distribution systems is that only a desired amount of fuel be delivered to each engine cylinder and that the amount be equal from cylinder to cylinder. It is therefore important that the delivery ducts be sealed from undesired fuel such as that which may by-pass around the bushing body and seep into the delivery ducts, and as can be appreciated, it is very difficult to control seeping fuel.

According to the present invention as shown in FIG. 10, the entrance port to the delivery passage 18 begins at the outside of the bushing wall and continues to the bore as required to permit the entrance of fuel. It continues on the other side of the bore but at 90° to the entrance and stays within the bushing body up to groove 31 and out to the delivery valves. This is different from the prior art, as shown in FIG. 2 of British Pat. No. 611,423 accepted Oct. 29, 1948, in which the delivery passage begins at the outside of the bushing wall, extends completely through the bushing body and ends at the outside of the bushing wall and which may permit fuel seeping between the outside bushing wall and the pump body to reach the delivery passage leading to the delivery valves.

The reason for the flat upper face of the cam lobe is to provide a distributing system in which the successively operated distributor valve plungers remain stationary when in the distributing position. The length of cam lobe 24 is such that the plungers are held in the distributing position throughout the entire delivery stroke of the pump plunger.

In systems in which the valve is non-stationary during the fuel distribution, the fuel under pressure acts as an abrasive against the ports of the fuel passage as the components move during the distribution of fuel. According to the present invention, the valve plungers are stationary during distribution. Referring to FIG. 1, the delivery valve plunger shown on the right-hand portion of the drawing is maintained in a position where annular groove 17 is in alignment with channel 18 through the entire upstroke of plunger 5.

Returning to FIG. 4, the pump housing, which may contain a governor (not shown) includes a control lever shaft 48. A pump contol lever 49, which may be operated manually is connected with positioning rack 10 through intermediate linkage 46 and intermediate lever 47 mounted on the control lever shaft. The fuel output of the fuel pump is determined by the positioning of the pump control lever 49, which may be positioned to provide for a maximum or minimum R.P.M. or fuel output. The pump control level is held in idle position by idle stop piston screw 45, which may be pressed inwardly to permit the control rack to be moved to a stop or neutral position in which no fuel is delivered.

In summarizing the operation of the mechanical fuel pump according to this invention, only one of the distributor valves is held in an open position by flat-faced distributor cam lobe 24 at any one time. When the distributor valve is in its open position the pump plunger 5 moves upwardly through a delivery stroke, and fuel passes around valve 51 through delivery duct 14 to the delivery valve via drilling 18 extending through distributor valve bushing 15. Annular groove 17 permits passage of the fuel around the distributor valve plunger when it is in the open position. Groove 17 therefore forms a continuation of delivery passage 18. From there the fuel passes via annular channels 31 and 32 to drilling 33 into the bore of delivery valve body 20. The fuel which is under pressure forces delivery valve 19 against spring 21 off its seat and thereafter flows from the distributor through the passage provided in fitting 22. The same sequence of events occurs each time distributor cam 23 provided with cam lobe 24 moves each of the distributor valves to an open position.

Each of the distributor valves is held in an open position connecting the channel 18 throughout the entire delivery stroke of pump plunger 5. The diameter of the distributor cam would of course be increased with an increasing number of distributor valves, and the number of distributor valves would equal the number of cylinders in the multi-cylinder engine in which the injection fuel pump is to be used.

Furthermore, the distributor system according to this invention, may be operated in conjunction with any suitable pump unit or a pumping system including a plurality of pumping pistons. It is also feasible to provide a pump unit employing a different type of metering device from that described above.

Figure 11:
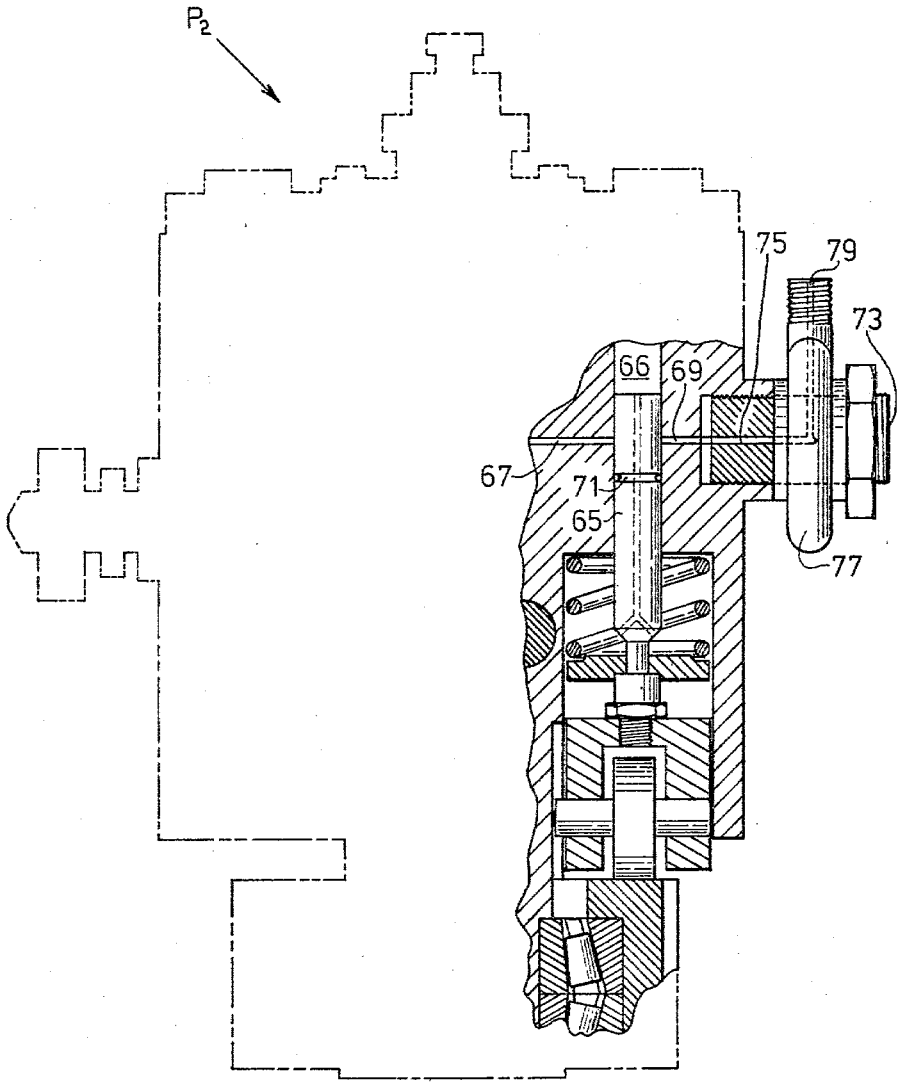
FIG. 11 is a part sectional elevational view of another embodiment of a fuel injection pump head according to this invention showing an alternative method of delivering fuel from the distributor to the cylinders of an engine.

According to another embodiment of the invention, FIG. 11 shows a different distributor valve arrangement which operates on the same principle as that shown in FIG. 1 through 10. A fuel injection pump head indicated at P2 includes distributor valves 65 which operate in the same principle as distributor valve 16. However, according to this embodiment, the distributor valve cylinder bores 66 are formed within the pump casing. A plurality of distributor valves 65 are reciprocating in a close fit within their bores 66.

Fuel is pumped and metered by a pumping unit (not shown) through fuel delivery duct 67 to the valve bores. When the distributor valve is in a closed position, i.e., its lower most position, no fuel can pass around the distributor valve plunger. However, when one of the distributor valve plungers is in its upper open position, fuel flows around groove 71 to passage 69, which in this embodiment extends laterally rather than vertically of the distributor assembly. Threaded into the side of the pump casing is a nipple 73 having an internal passage 75 which is connected to passage 69. Fitted into nipple 73 is a tubular fitting 77 provided with a delivery passage 79. Delivery passage 79 is in turn connected to passage 75. When distributor valve 65 is in its open position, the fuel passing around annular groove 71 flows through lateral passages 69 and 75 and upwardly through vertical delivery passage 79.

What I claim is:

1. A fuel injection apparatus for use in a multi-cylinder internal combustion engine; said apparatus comprising a pump head, including a pump head casing; a central pump unit consisting of a pump plunger bushing and a pump plunger reciprocal in the pump plunger bushing, and including a fuel metering means so that said pump unit both meters and pumps fuel; a distributor apparatus comprising a plurality of distributor valves arranged in a circular pattern about said central pump unit, and including valve plungers; a rotary distributor cam having a single distributor lobe for orbiting in said circular pattern and moving said valve plungers in succession from a non-distributing to a distributing position in sequence with the delivery stroke of said pump unit; said distributor having a planar face for holding said valve plungers stationary when in the distributing position through the entire delivery stroke of said pump unit; spring means for returning said valve plungers to said non-distributing position where they rest on a flat surface of said distributor cam through said casing and into said pump plunger bushing; delivery ducts extending from said pump plunger bushing; delivery ducts extending from said pump unit to said distributor valves; and cam and spring means for reciprocating said pump plunger, each of said distributor valves distributing in succession fuel metered and pumped by said pump unit.

2. A fuel injection apparatus as claimed in claim 1, including a fuel reservoir surrounding the pump plunger bushing, said fuel inlet supplying fuel to the fuel reservoir, a spill port in the pump bushing for the return of excess fuel after metering to the supply source, a spill sleeve extending from the spill port bushing through the fuel reservoir, and a return fuel line; said spill sleeve directing the excess fuel to the return fuel line thereby isolating the spill port from the fuel reservoir.

* * * * *